US008735335B2

(12) United States Patent
Shirahama et al.

(10) Patent No.: US 8,735,335 B2
(45) Date of Patent: May 27, 2014

(54) BASE OIL FOR HYDRAULIC OIL AND COMPOSITION USING THE SAME

(75) Inventors: Shinichi Shirahama, Kanagawa (JP); Tooru Aoki, Kanagawa (JP); Mitsuaki Ishimaru, Kanagawa (JP)

(73) Assignee: Nippon Oil Corporation, Tokyo (JP)

( * ) Notice: Subject to any disclaimer, the term of this patent is extended or adjusted under 35 U.S.C. 154(b) by 0 days.

(21) Appl. No.: 13/417,904

(22) Filed: Mar. 12, 2012

(65) Prior Publication Data

US 2012/0172268 A1 Jul. 5, 2012

Related U.S. Application Data

(62) Division of application No. 11/993,288, filed as application No. PCT/JP2006/312811 on Jun. 27, 2006, now abandoned.

(30) Foreign Application Priority Data

Jun. 29, 2005 (JP) ..... 2005-189905

(51) Int. Cl.
*C10M 101/00* (2006.01)
*C10M 105/04* (2006.01)

(52) U.S. Cl.
CPC ..... *C10M 1/08* (2013.01); *C10M 105/04* (2013.01); *C10M 2203/003* (2013.01); *C10M 2203/045* (2013.01); *C10M 2203/1006* (2013.01); *C10M 2203/1025* (2013.01); *C10M 2203/1065* (2013.01); *C10N 2220/025* (2013.01); *C10N 2220/028* (2013.01)
USPC ..... 508/110; 508/469

(58) Field of Classification Search
CPC ..... C10M 1/08; C10M 101/02; C10M 2203/003; C10M 2203/045; C10M 2203/1006; C10M 2203/1025; C10M 2203/1065; C10N 2220/025; C10N 2220/028
USPC ..... 508/110, 469
See application file for complete search history.

(56) References Cited

U.S. PATENT DOCUMENTS

| | | | | |
|---|---|---|---|---|
| 4,059,534 | A | 11/1977 | Morro et al. | |
| 6,255,546 | B1 | 7/2001 | Alexander | |
| 2004/0176256 | A1 | 9/2004 | Kurosawa et al. | |
| 2004/0224860 | A1 | 11/2004 | Baba et al. | |
| 2005/0096236 | A1* | 5/2005 | Le Sausse et al. | 508/439 |
| 2006/0131210 | A1* | 6/2006 | Rosenbaum et al. | 208/18 |

FOREIGN PATENT DOCUMENTS

| | | | |
|---|---|---|---|
| EP | 1 845 151 | A1 | 10/2007 |
| JP | 06-200269 | A | 7/1994 |
| JP | 06-240283 | A | 8/1994 |
| JP | 07-109477 | A | 4/1995 |
| JP | 09-165590 | A | 6/1997 |
| JP | 09-165592 | A | 6/1997 |
| JP | 2000-109877 | A | 4/2000 |
| JP | 2001-311090 | A | 11/2001 |
| JP | 2002-501558 | A | 1/2002 |
| JP | 2003-522280 | A | 7/2003 |
| JP | 2004-059930 | A | 2/2004 |
| JP | 2004-182931 | A | 7/2004 |
| JP | 2005-154760 | A | 6/2005 |
| JP | 2005-213447 | A | 8/2005 |
| WO | 2006/073198 | A1 | 7/2006 |

OTHER PUBLICATIONS

USPTO NFOA mailed Oct. 8, 2010 in connection with U.S. Appl. No. 11/993,288.
USPTO FOA mailed Mar. 22, 2011 in connection with U.S. Appl. No. 11/993,288.
USPTO NFOA mailed Jul. 11, 2011 in connection with U.S. Appl. No. 11/993,288.
USPTO FOA mailed Nov. 25, 2011 in connection with U.S. Appl. No. 11/993,288.
Supplementary European Search Report; dated Mar. 7, 2012; Appln. No./Patent No. 06767428.3-2104/ 1908816 PCT/JP2006312811.

* cited by examiner

*Primary Examiner* — Taiwo Oladapo
(74) *Attorney, Agent, or Firm* — Ladas & Parry LLP

(57) ABSTRACT

A base oil for hydraulic oil suitably used for hydraulic systems having filters of which micropore diameter is 50 μm or less is disclosed. The disclosure also provides a hydraulic oil composition using the above base oil, especially a hydraulic oil composition suitably used for such as tractors, transmissions, and common systems thereof having the hydraulic systems. The base oil has mineral oil, and the mineral oil is defined by kinematic viscosity at 100° C.: 1.5~6 $mm^2/s$, pour-point: −10° C. or less, viscosity index: 100 or more, % $C_P$: 70 or more, % $C_A$: 2 or less, and aniline point: 106° C. or more, and the mineral base oil is treated by catalytic dewaxing process and/or contains tertiary carbon atoms at a ratio of 7.4% or more to the total carbon atoms.

7 Claims, No Drawings

BASE OIL FOR HYDRAULIC OIL AND COMPOSITION USING THE SAME

RELATED APPLICATION

This application is a division of U.S. application Ser. No. 11/993,288, filed Dec. 20, 2007 (now abandoned) which is a national stage entry of PCT/JP2006/312811, filed Jun. 27, 2006 which claims foreign priority from Japanese Patent Application No. 2005-189905, filed Jun. 29, 2005, which is incorporated by reference in its entirety.

TECHNICAL FIELD

The present invention relates to a base oil for hydraulic oil suitably used for a hydraulic system having a filter of which micropore diameter is 50 μm or less. It also relates to a hydraulic oil composition using the same, more specifically, a hydraulic oil composition suitably used as a common lubricating oil for such as tractors having hydraulic systems and transmissions.

BACKGROUND ART

In the lubricating oils used at low temperature, in general, pour-point depressant and viscosity index improver are blended to improve the low-temperature properties. For example, as about engine oils, evaluation of cold cranking limit in according with CCS viscosity (ASTM D 5293) and of low-temperature pumping limit in according with MRV viscosity (ASTM D 4684), and so on are carried out; while, as about gear oils and transmission oils, evaluation of cold flow in accordance with BF viscosity (ASTM D 2983), and so on are carried out.

On the other hand, as about lubricating oils for tractor, the one particular lubricating oil is not only required to have ability of lubricating transmission, gears, bearings, hydraulic systems, power steering, wet-type brake, but also required to have special properties such as water resistance and filterability. Conventional lubricating oils for tractor are mainly required to improve extreme-pressure property to the gears and frictional property of wet-type clutch/wet-type brake (e.g., Patent Documents 1~7).

In addition to the above properties, the lubricating oils used for tractors in cold region are particularly required to have sufficient cold flow for the hydraulic pump starting at low temperature. A cold flow for such as tractors of which BF viscosity at −40° C. is 20,000 mPa·s or less is known (e.g., Patent Document 5).

Patent Document 1: Japanese Patent Application Laid-Open (JP-A) No. 6-200269
Patent Document 2: JP-A No. 6-240283
Patent Document 3: JP-A No. 7-109477
Patent Document 4: JP-A No. 9-165590
Patent Document 5: JP-A No. 9-165592
Patent Document 6: JP-A No. 2001-311090
Patent Document 7: JP-A No. 2004-059930

DISCLOSURE OF THE INVENTION

Problems to be Solved by the Invention

However, hydraulic equipment these days are equipped with precision valves for accurate control thereof, micropore diameter of filters arranged for preventing the contamination with foreign substance into the hydraulic pump becomes smaller. Therefore, in despite of having the above sufficient low-temperature viscosity, possibility of problems such as poor lubrication and malfunction of each lubricating portion because of the blockage of the micropore of filter, or long start-up time before normal operation are found out.

The present inventors have been studied the above problems. As a result, the inventors found the fact that even when a lubricating oil composition, which exhibits excellent low-temperature properties such that BF viscosity at −40° C. is 20,000 mPa·s or less, is used, flow in a hydraulic pump decreases at low temperature like −30° C. or less, particularly the phenomenon is remarkably seen in a hydraulic system having filters of which micropore diameter is 50 μm or less. The problems to be solved by the present invention is to provide a base oil for hydraulic oil suitably used for hydraulic systems having filters of which micropore diameter is 50 μm or less, which is capable to improve the decrease of flow in hydraulic pump at low temperature like −30° C. or less and is capable to normally operate the hydraulic systems. The invention also provides a hydraulic oil composition using the above base oil, especially a hydraulic oil composition suitably used for such as tractors having hydraulic systems and transmissions, and a hydraulic oil composition commonly used for both of them.

Means for Solving the Problems

The present inventors have been conducted serious studies in order to solve the above problems. As a result, base oil for hydraulic oil using particular mineral oil is useful to solve the above problems; further, hydraulic oil composition obtained by adding a poly (meth)acrylate series additive to the base oil for hydraulic oil is also useful to solve the above problems, and the present invention is completed.

The first aspect of the present invention is a base oil (A) for hydraulic oil comprising mineral oil, wherein the mineral oil is defined by kinematic viscosity at 100° C.: 1.5~6 $mm^2/s$, pour-point: −10° C. or less, viscosity index: 100 or more, % $C_P$: 70 or more, % $C_A$: 2 or less, and aniline point: 106° C. or more; and the mineral base oil is treated by catalytic dewaxing process and/or contains tertiary carbon atoms at a ratio of 7.4% or more to the total carbon atoms.

The second aspect of the invention is a base oil for hydraulic oil comprising the above base oil (A) at a ratio of 10 mass % or more to total mass of the base oil for hydraulic oil, and a base oil (B) of which kinematic viscosity at 100° C. is 1.5~6 $mm^2/s$ and of which aniline point is less than 106° C. at a ratio of 50 mass % or less to total mass of the base oil.

The third aspect of the invention is a hydraulic oil composition comprising the above base oil containing a poly (meth) acrylate series additive.

The hydraulic oil composition of the third aspect of the invention is preferably used for hydraulic systems having oil filters of which micropore diameter is 50 μm or less. Moreover, the hydraulic oil composition is preferably a common lubricating oil for both hydraulic systems and transmissions.

Effects of the Invention

The base oil for hydraulic oil of the present invention and the hydraulic oil composition using the same are suitably used for hydraulic systems having hydraulic pumps and filters of which micropore diameter is 50 μm or less, which is capable to improve the decrease of flow in hydraulic pump at low temperature like −30° C. or less and is capable to normally operate the hydraulic systems. These are particularly used as a hydraulic oil and the composition suitably used for such as tractors having the hydraulic systems and transmissions, and a hydraulic oil composition commonly used for both of them.

Such effects of the inventions will be made apparent from the best mode for carrying out the invention, which will be described as follows.

BEST MODE FOR CARRYING OUT THE INVENTION

The present invention is described in detail as follows. The base oil for hydraulic oil of the invention is the one suitably used for hydraulic systems having oil filters of which micropore diameter is 50 μm, and it is a base oil (A) for hydraulic oil comprising a mineral oil, wherein the mineral oil is defined by kinematic viscosity at 100° C.: 1.5~6 $mm^2/s$, pour-point: −10° C. or less, viscosity index: 100 or more, % $C_P$: 70 or more, % $C_A$: 2 or less, and aniline point: 106° C. or more; and wherein dewaxed mineral base oil treated by catalytic dewaxing process and/or a mineral base oil containing tertiary carbon at a ratio of 7.4% or more to the constituted entire carbon is contained in the mineral base oil.

The manufacturing method of the base oil (A) for hydraulic oil of the invention is not specifically limited as long as it satisfies the above requirements. For example, a hydrocracked mineral oil and/or wax isomerized isoparaffinic base oil manufactured in accordance with the following process:

firstly, one or more raw material selected from (1)~(8) below or lubricant fraction recovered from the raw material is hydrocracked or treated by wax isomerization; the product itself or lubricant fraction from the product is recovered; then, the extracted product or lubricant fraction is processed by dewaxing treatment such as solvent dewaxing and catalytic dewaxing; later, these are processed by solvent refining treatment; or they are produced by solvent refining treatment and by dewaxing treatment such as solvent dewaxing and catalytic dewaxing. Such a hydrocracked mineral oil and/or wax isomerized isoparaffinic base oil are preferably used.

(1) distillated oil obtained by topping of paraffinic crude oil and/or mixed base crude;

(2) whole vacuum gas oil (WVGO) of topping residue of paraffinic crude and/or mixed base crude;

(3) wax obtained by lubricating oil dewaxing process and/or Fischer-Tropsch wax manufactured by GTL process or the like;

(4) a mildly hydrocracked (MHC) oil selected from (1)~(3), or MHC oil of mixed oil of two or more oils selected from (1)~(3);

(5) mixed oil of two or more oils selected from (1)~(4);

(6) de-asphalted oil (DAO) of (1), (2), (3), (4) or (5);

(7) mildly hydrocracked (MHC) oil of (6);

(8) lubricating oil obtained by the following method: a mixed oil of two or more oils selected from (1)~(7) is prepared as a raw material, the raw material and/or lubricant fraction extracted from the raw material are refined by a normal refining method, then the lubricant fraction of the refined oil is extracted for the use of lubricating oil.

The above normal refining method is not particularly limited, any kind of refining methods used for manufacturing lubricant base oil can be adopted. Examples of the normal refining method include:

(i) hydrorefining such as hydrocracking and hydrofinishing;

(ii) solvent refining such as furfural solvent extraction;

(iii) dewaxing such as solvent dewaxing and catalytic dewaxing;

(iv) clay treatment by using acid clay and activated clay;

(v) chemical (acid or alkali) treatment such as sulfuric acid treatment and caustic soda treatment.

In the invention, one or more of these methods can be optionally combined and adopted in an arbitrary order. The base oil (A) for hydraulic oil of the invention may adopt any one of the above dewaxing methods; the base oil (A) for hydraulic oil is preferably a base oil treated by catalytic dewaxing, more preferably a base oil treated by catalytic isomerization dewaxing, specifically preferably a base oil treated by hydroisomerization dewaxing. By using the base oil treated by catalytic dewaxing, (for example, compared with a case using a base oil treated by solvent dewaxing of which low-temperature properties like pour-point and base oil composition are substantially the same as those of the above base oil treated by catalytic dewaxing), it is capable to obtain a hydraulic oil composition which exhibits excellent filterability at low temperature.

The base oil (A) for hydraulic oil of the present invention is one or more base oils selected from base oils of which kinematic viscosity at 100° C. is 1.5~6 $mm^2/s$; in view of excellent lubricity and low-temperature properties, the kinematic viscosity at 100° C. is preferably 2~5 $mm^2/s$, particularly preferably 2.5~4.5 $mm^2/s$. More specific examples of the base oil for hydraulic oil of the invention include:

(A1) a base oil of which kinematic viscosity at 100° C. is 3.5~4.5 $mm^2/s$, more preferably 3.8~4.3 $mm^2/s$;

(A2) a base oil of which kinematic viscosity at 100° C. is 1.5~3.5 $mm^2/s$, more preferably 2.5~3.5 $mm^2/s$, particularly preferably 3~3.4 $mm^2/s$; and a mixed base oil of (A1) and (A2).

In addition, pour-point of the base oil (A) for hydraulic oil of the invention is −10° C. or less, in view of balance between the low-temperature properties and the manufacturing cost, it is preferably −50~−15° C. Pour-point of the above (A1) is preferably −35~−10° C., more preferably −25~−15° C., particularly preferably −20~−15° C. And pour-point of the above (A2) is preferably −50~−15° C., more preferably −45~−20° C., particularly preferably −45~−25° C. These base oils can be obtained by the above dewaxing treatment in the dewaxing method.

More over, viscosity index of the base oil (A) for hydraulic oil of the invention is 100 or more, preferably 105~160; viscosity index of the above (A1) is preferably 115 or more, more preferably 120~160, particularly preferably 120~150; and viscosity index of the above (A2) is preferably 100 or more, more preferably 105~130, particularly preferably 105~125. By using the base oil having the above range of viscosity index, it is capable to obtain a hydraulic oil composition which exhibits excellent stability and filterability at low temperature.

The composition of the base oil (A) for hydraulic oil of the invention is expressed by that % $C_P$ is 70~100, preferably 73~90, more preferably 74~85, and particularly preferably 75~80; % $C_A$ is 2 or less, preferably 1 or less, particularly preferably 0.3 or less; and % $C_N$ is 0~30, preferably 15~27, particularly preferably 21~26. The composition of the above (A1) and (A2) are also preferably within the above range. By using the base oil of which composition is within the above range, it is capable to obtain a hydraulic oil composition which not only exhibits high viscosity index but also exhibits excellent stability and filterability at low temperature. In the invention, % $C_P$ means the percentage of paraffinic carbon number to total carbon number, % $C_A$ means the percentage of aromatic carbon number to total carbon number, and % $C_N$ means the percentage of naphthenic carbon number to total carbon number; these of which are respectively measured by a method in accordance with ASTM D 3238~85. Although results of the analysis may possibly out of the applicable range, % $C_P$, % $C_A$, and % $C_N$ of the invention means numerical values calculated by the above testing method.

Aniline point of the base oil (A) for hydraulic oil of the present invention is 106° C. or more, preferably 106~125. Aniline point of the above (A1) is preferably 110~125, more preferably 114~120; and aniline point of the above (A2) is preferably 106~115, more preferably 106~112, particularly preferably 107~110. By using a base oil of which aniline point is within the above range, it is capable to obtain a hydraulic oil composition which not only exhibits high viscosity index but also exhibits excellent stability and filterability at low temperature. Moreover, by using the same, it is capable to minimize swelling and contraction of seals in circulatory systems such as hydraulic system in which the hydraulic oil is used. In the invention, aniline point means the aniline point measured in accordance with JIS K 2256-1985.

Sulfur content of the base oil (A) for hydraulic oil of the present invention, from the viewpoint of enhancing the stability of the composition, is preferably 0.05 mass % or less, more preferably 0.005 mass % or less, particularly preferably 0.001 mass % or less. Sulfur of the above (A1) and (A2) are preferably within the above range, respectively.

As the dewaxing method to obtain the base oil (A) for hydraulic oil of the invention, it is preferably a method including a catalytic dewaxing process, particularly preferably a method including a catalytic isomerization dewaxing process or the above-mentioned hydroisomerization dewaxing process. Among the base oil (A) for hydraulic oil of which kinematic viscosity, pour-point, base oil composition, and aniline point are within the above range, if a base oil, which is processed by dewaxing treatment in a method including catalytic dewaxing process, is selected and used, it is capable to obtain a hydraulic oil composition which exhibits excellent filterability at low temperature.

The ratio of tertiary carbon to total carbon of hydrocarbon constituting the base oil (A) for hydraulic oil of the present invention is preferably 7.4% or more, more preferably 7.4~10%; the ratio of tertiary carbon to total carbon of hydrocarbon constituting the above (A1) is preferably 7.5% or more, more preferably 7.8~10%; and the ratio of tertiary carbon to total carbon of hydrocarbon constituting the above (A2) is preferably 7.4% or more, more preferably 7.5~10%. Among the base oil (A) for hydraulic oil of which kinematic viscosity, pour-point, base oil composition, and aniline point are within the above range, if any one of base oils are selected from a group consisting of a mineral base oil treated by dewaxing in a method including catalytic dewaxing process, a mineral base oil (it may be the one treated by dewaxing in a process other than catalytic dewaxing) of which ratio of tertiary carbon is within the above range, or a mineral base oil treated by dewaxing in a method including catalytic dewaxing process, and of which ratio of tertiary carbon is within the above range and are used, (though detailed reasons are unknown) it is capable to obtain a hydraulic oil composition which exhibits excellent filterability at low temperature. In the present invention, it is most preferable to use the mineral base oil treated by dewaxing in a method including catalytic dewaxing process, and of which ratio of tertiary carbon is within the above range.

The ratio of tertiary carbon to total carbon of hydrocarbon constituting the base oil for hydraulic oil means the ratio of carbon atom attributing to the structure represented by:

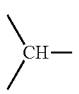

in the total carbon atom. In other words, it means the ratio of carbon atom attributing to branching or naphthenic structure.

The ratio of tertiary carbon to total carbon of hydrocarbon constituting the base oil for hydraulic oil means a ratio of the sum of integral intensity measured by $^{13}$C-NMR attributed to the tertiary carbon to the sum of integral intensity measured by the same of total carbon atom. If equivalent result to this can be obtained by other methods, those may be used. When $^{13}$C-NMR measurement is carried out, as a sample, a material having 0.5 g of sample to which 3 g of deuterated chloroform is added for dilution is used. The measured temperature is room temperature, the resonance frequency is set at 100 MHz, and the measurement method is gate decoupling method.

According to the above analysis, (a) sum of integral intensity of the chemical shift at about 10-50 ppm (sum of integral intensity of the hydrocarbon attributed to total carbon); and (b) sum of integral intensity of the chemical shift at about 27.9-28.1 ppm, 28.4-28.6 ppm, 32.6-33.2 ppm, 34.4-34.6 ppm, 37.4-37.6 ppm, 38.8-39.1 ppm, and 40.4-40.6 ppm (sum of integral intensity attributed to methyl group, ethyl group, and both tertiary carbon and naphthenic tertiary carbon having branching group), are respectively measured, and the ratio of (b) (%) to (a) as 100% is calculated. The ratio of (b) shows a ratio of total tertiary carbon atom to total carbon atom constituting the base oil.

Although average carbon number of the base oil (A) for hydraulic oil of the invention is not particularly limited, it is preferably in the range of 20~35; average carbon number of (A1) is preferably in the range of 25~35, more preferably 28~30; and average carbon number of (A2) is preferably in the range of 20~28, more preferably 23~25.

In addition, when the base oil for hydraulic oil of the invention consists of the above base oil (A) for hydraulic oil, by setting the kinematic viscosity at 100° C. of the base oil of the hydraulic oil composition of the invention to 3.5~4.5 $mm^2/s$, the requirement of lubricity and low-temperature properties are satisfied. Therefore, for the base oil for hydraulic oil of the invention, the above (A1) is preferably used as the essential component; so as to further improve the low-temperature filterability, it is preferable to use both (A1) and (A2) at the same time. In such a case, the ratio of (A1), to total base oil, is 10~100 mass %, preferably 30~90 mass %, and more preferably 50~80 mass %; while, the ratio of (A2) is 0~90 mass %, preferably 10~70 mass %, and more preferably 20~50 mass %.

In the base oil for hydraulic oil of the present invention, the above base oil (A) and mineral base oil other than (A), i.e. a mineral raw material described in (1)~(8) listed in the manufacturing method of the base oil (A); and a mineral base oil, which does not satisfy the specification of the base oil (A), among the mineral base oil selected from hydrocracked mineral oil and/or wax isomerized mineral oil manufactured by the methods listed in the manufacturing methods of the base oil (A), may be blended and used.

Specific examples of the mineral oil other than the above base oil (A) may be the following base oil, and the like.

(B) a mineral oil of which kinematic viscosity at 100° C. is 1.5~6 $mm^2/s$, and of which aniline point is less than 106° C.;

(C) a mineral oil of which kinematic viscosity at 100° C. is 1.5~6 $mm^2/s$, and of which aniline point is 106° C. or more, which is treated by solvent dewaxing, and in which the ratio of tertiary carbon to total carbon in the hydrocarbon constituting the base oil is less than 7.4%; and (D) a mineral oil which does not meet any one of (A), (B), and (C).

A specific example of the above base oil (B) may be the following.

(B1) a mineral base oil of which kinematic viscosity at 100° C. is 1.5~6 $mm^2/s$, preferably 3.5~4.5 $mm^2/s$, of which aniline point is less than 106° C., preferably 90~104° C. More precisely, a mineral base oil having the above properties such as solvent-refined mineral oil. Viscosity index of (B1) is preferably 80~110, more preferably 95~105; pour-point of (B1) is preferably −10~−35° C., more preferably −15~−25° C.; then, % $C_P$ of (B1) is preferably 60~70, % $C_A$ of the same is preferably 2~10, more preferably 3~8.

Moreover, another specific example of (B) may be the following.

(B2) a mineral base oil of which kinematic viscosity at 100° C. is 1.5~6 $mm^2/s$, preferably 2~3.5 $mm^2/s$, of which aniline point is less than 106° C., more preferably 100~105° C. More precisely, a mineral base oil having the above properties such as hydrocracked mineral oil and/or wax isomerized mineral oil. Viscosity index of (B2) is preferably 80~115, more preferably 100~115, and particularly preferably 105~110; pour-point of (B2) is preferably −10° C. or less, more preferably −25~−35° C.; % $C_P$ of (B2) is preferably 70~85, more preferably 75~80, % $C_A$ of the same is preferably 2 or less, more preferably 0.3~1.5, and % $C_N$ of the same is preferably 15~30, more preferably 21~26. (B2) is a hydrocracked mineral oil and/or wax isomerized mineral oil treated by dewaxing in the solvent dewaxing process, it may be equivalent to the mineral base oil in which the ratio of tertiary carbon to total carbon in the hydrocarbon constituting the base oil is less than 7.4%.

A specific example of the above base oil (C) may be a mineral base oil of which kinematic viscosity at 100° C. is 1.5~6 $mm^2/s$, preferably 3.5~5 $mm^2/s$, and more preferably 3.8~4.4 $mm^2/s$, of which aniline point is 106° C. or more, more preferably 108~125° C., and further preferably 110~120; the base oil (C) is treated by solvent dewaxing, and the ratio of tertiary carbon to total carbon in the hydrocarbon constituting the base oil is less than 7.4%. More precisely, a mineral base oil having the above properties such as hydrocracked mineral oil and/or wax isomerized mineral oil. Viscosity index of (C) is preferably 100~160, more preferably 115~135, more preferably 120~130; pour-point of (C) is preferably −10° C. or less, more preferably −15~−25° C.; % $C_P$ is preferably 70~100, more preferably 72~90, and furthermore preferably 75~85; and % $C_A$ is preferably 2 or less, more preferably 0.3~1.5.

A specific example of the above base oil (D) may be a mineral base of which kinematic viscosity at 100° C. is less than 1.5 $mm^2/s$ and over 6 $mm^2/s$. Typically, it may be solvent-refined mineral oil, hydrocracked mineral oil and/or wax isomerized mineral oil, or the like of which kinematic viscosity at 100° C. is over 6 $mm^2/s$ and 50 $mm^2/s$ or less, preferably 8~35 $mm^2/s$.

In the base oil for hydraulic oil of the invention, when the above base oil (A) and a mineral base oil other than the base oil (A) are blended and used, the ratio of (A), to total mass of the base oil, is preferably 10~90 mass %, more preferably 20~80 mass %, and furthermore preferably 30~70 mass %; and the ratio of the mineral base oil other than the base oil (A) is preferably 10~90 mass %, more preferably 20~80 mass %, and furthermore preferably 30~70 mass %. If the base oil (B) is blended as the mineral base oil other than the base oil (A), the ratio thereof is necessary to be 50 mass % or less, preferably 40 mass % or less to total mass of the base oil. The base oil (B) can be manufactured at low cost compared with the base oil (A), namely, the manufacturing cost is more advantageous. So, it is favorably blended at a ratio of preferably 5 mass % or more, more preferably 10 mass % or more, furthermore preferably 20 mass % or more, and particularly preferably 30 mass % or more.

When base oil (C) is used, the ratio thereof, to total mass of the base oil, is 10~90 mass %, preferably 20~80 mass %, and more preferably 30~70 mass %. Also, when base oil (D) is used, unless the effect of this invention is inhibited remarkably, for instance, it is favorably blended at a ratio of 40 mass % or less, preferably 20 mass % or less, to total mass of the base oil. However, the base oil of which kinematic viscosity at 100° C. is over 6 $mm^2/s$ may have a possibility to especially block the low-temperature filterability, thus, it is preferable not to blend the base oil (D) having such viscosity as far as there is no necessity for improving the wear preventive effect.

Further, to the base oil for hydraulic oil of the present invention, synthetic base oil and/or natural oil may be blended.

Specific examples of the synthetic lubricant base oil include: poly-α-olefin or the hydrogenated product thereof, isobutene oligomer or the hydrogenated product thereof, isoparaffin, alkyl benzene, alkyl naphthalene, diester (e.g., ditridecyl glutalate, di-2-ethylhexyl adipate, diisodecyl adipate, ditridecyl adipate, di-2-ethylhexyl sebacate, etc.), polyol ester (e.g., trimethylol propane caprilate, trimethylol propane pelargonate, pentaerythritol-2-ethyl hexanoate, pentaerythritol pelargonate, etc.), polyoxy alkylene glycol, dialkyl diphenylether, polyphenylether, and so on. As the favorable synthetic lubricant base oil, there may be poly-α-olefin, or polyol ester, most preferably poly-α-olefin. The poly-α-olefin may be, typically, oligomer or cooligomer of α-olefin having carbon number 2~32, preferably 6~16 (e.g., 1-octene oligomer, 1-decene oligomer, ethylene-propylene cooligomer, etc.) and the hydride thereof. Since these exhibit high viscosity index, and excellent low-temperature properties, to the degree which does not raise the cost high, for example, to total mass of the base oil, these can be blended at the ratio of 40 mass % or less, preferably 20 mass % or less.

While, specific examples of the natural oil include: animal oil such as beef tallow, lard, and fish oil; and plant oil such as rapeseed oil, soybean oil, palm oil, palm kernel oil, sunflower oil, high oleic rapeseed oil, and high oleic sunflower oil. Since these can enhance biodegradability of the base oil, to the degree which does not raise the cost high, for example, to total mass of the base oil, these can be blended at the ratio of 40 mass % or less, preferably 20 mass % or less.

The hydraulic oil composition of the present invention is a hydraulic oil composition in which the above base oil for hydraulic oil includes a poly (meth)acrylate series additive (E).

The (E) component in the lubricating oil composition of the invention is a poly (meth)acrylate series additive. As the (E) component, usually, a component of which weight-average molecular weight is 10,000~1,000,000 is applicable. In view of easiness of improving viscosity-temperature property, especially the low-temperature viscosity property, the weight-average molecular weight of the (E) component may be preferably 50,000~500,000, more preferably 50,000~300,000. Here, the weight-average molecular weight means a polystyrene equivalent weight-average molecular weight obtained by using two columns of GMHHR-M manufactured by Tosoh Corporation (7.8 mm ID×30 cm) set in series in 150-C ALC/GPC apparatus manufactured by Waters Corporation, and by measured by Refractive Index detector (RI) with tetrahydrofuran as a solvent, under a condition of temperature at 23° C., velocity of flow at 1 mL/min, sample concentration: 1 mass %, and injection quantity of the sample: 75 μL. If equivalent result to this can be obtained, similar methods using similar apparatus may be applied.

The (E) component of the present invention is preferably a poly (meth)acrylate series additive having a structural unit represented by the following general formula (1).

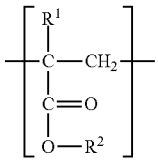

(1)

In the general formula (1), $R^1$ is a hydrogen or a methyl group, preferably a methyl group; and $R^2$ is a hydrocarbon group of carbon number 1~30 or a group represented by —$(R)_a$-E (here, "R" means an alkylene group of carbon number 1~30, "E" means amine residue or heterocyclic residue either of which contains 1~2 of nitrogen atoms and 0~2 of oxygen atoms, and "a" means an integer number of 0 or 1.

Examples of the alkyl group having carbon number 1~30 represented by $R^2$ include: methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, icosyl, docosyl, tetracosyl, hexacosyl, octacosyl, and so on (these alkyl groups may be straight-chain or branched).

Examples of the alkylene group having carbon number 1~30 represented by R include: methylene, ethylene, propylene, butylene, pentylene, hexylene, heptylene, octylene, nonylene, decylene, undecylene, dodecylene, tridecylene, tetradecylene, pentadecylene, hexadecylene, heptadecylene, octadecylene, and so on (these alkyl groups may be straight-chain or branched).

When E is an amine residue, the specific examples may be dimethyl amino, diethyl amino, dipropyl amino, dibutyl amino, anilino, toluidino, xylidino, acetyl amino, benzoyl amino, and the like. When E is a heterocyclic residue, the specific examples may be morpholino, pyrrolyl, pyrrolino, pyridyl, ethylpyridyl, pyrrolidinyl, piperidinyl, quinonyl, pyrrolidonyl, pyrrolidono, imidazolino, and pyrazino.

As a poly (meth)acrylate having the structural unit represented by the general formula (1), there may be a poly (meth) acrylate obtained by polymerizing or copolymerizing one or more monomers represented by the following general formula (2).

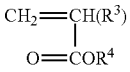

(2)

($R^3$ and $R^4$ in the general formula (2), are the same as the $R^1$ and $R^2$ in the general formula (1), respectively.)

Specific examples of the monomer represented by the general formula (2) may be monomers shown in the following (E1)~(E5).

(E1) A (Meth)Acrylate Having an Alkyl Group of Carbon Number 1~4:

As an (E1) component, there may be methyl (meth)acrylate, ethyl (meth)acrylate, n- or i-propyl (meth)acrylate, n-, i- or sec-butyl (meth)acrylate; it is preferably methyl (meth) acrylate.

(E2) A (Meth)Acrylate Having an Alkyl Group or an Alkenyl Group of Carbon Number 5~15:

As an (E2) component, there may be octyl (meth)acrylate, nonyl (meth)acrylate, decyl (meth)acrylate, undecyl (meth) acrylate, dodecyl (meth)acrylate, tridecyl (meth)acrylate, tetradecyl (meth)acrylate, pentadecyl (meth)acrylate (these may be straight-chain or branched); octenyl (meth)acrylate, nonenyl (meth)acrylate, decenyl (meth)acrylate, undecenyl (meth)acrylate, dodecenyl (meth)acrylate, tridecenyl (meth) acrylate, tetradecenyl (meth)acrylate, pentadecenyl (meth) acrylate, and so on (these may be straight-chain or branched). It is preferably a (meth)acrylate mainly containing a straight-chain alkyl group of carbon number 12~15.

(E3) A (Meth)Acrylate Having a Straight-Chain Alkyl Group or Alkenyl Group of Carbon Number 16~30:

As an (E3) component, it is preferably a (meth)acrylate having a straight-chain alkyl group of carbon number 16~20, more preferably a (meth)acrylate having a straight-chain alkyl group of carbon number 16 or 18; specific examples thereof may be n-hexadecyl (meth)acrylate, n-octadecyl (meth)acrylate, n-icosyl (meth)acrylate, n-docosyl (meth) acrylate, n-tetracosyl (meth)acrylate, n-hexacosyl (meth) acrylate, n-octacosyl (meth)acrylate, and so on; particularly, n-hexadecyl (meth)acrylate, and n-octadecyl (meth)acrylate are preferable.

(E4) A (Meth)Acrylate Having a Branched Alkyl Group or Alkenyl Group of Carbon Number 16~30:

As an (E4) component, it is preferably a (meth)acrylate having a branched alkyl group of carbon number 20~28, more preferably a branched alkyl group of carbon number 22~26; specific examples thereof may be branching hexadecyl (meth)acrylate, branching octadecyl (meth)acrylate, branching icosyl (meth)acrylate, branching docosyl (meth)acrylate, branching tetracosyl (meth)acrylate, branching hexacosyl (meth)acrylate, branching octacosyl (meth)acrylate, and so on. It is preferably a (meth)acrylate having a branching alkyl group of carbon number 16~30, preferably carbon number 20~28, more preferably carbon number 22~26, respectively represented by a formula: —C—C($R^5$)$R^6$. $R^5$ and $R^6$ are not limited as long as carbon number of $R^4$ becomes in the range of 16~30; $R^5$ is a straight-chain alkyl group of preferably carbon number 6~12, more preferably carbon number 10~12; $R^6$ is a straight-chain alkyl group of preferably carbon number 10~16, more preferably carbon number 14~16.

As an (E4) component, more specific examples include a (meth)acrylate having branching alkyl group of carbon number 20~30 such as 2-decyl-tetradecyl (meth)acrylate, 2-dodecyl-hexadecyl (meth)acrylate, 2-decyl-tetradecyloxy ethyl (meth)acrylate.

(E5) Monomer Containing Polar Group:

Examples of (E5) component include: vinyl monomer containing amide group, monomer containing nitro group, vinyl monomer containing primary- to tertiary-amino group, and nitrogen heterocyclic vinyl monomer; and hydrochloride, hydrosulfate, phosphate, lower alkyl (carbon number 1~8) monocarboxylate of the above monomers; vinyl monomer containing quaternary ammonium salt, ampholytic vinyl monomer containing oxygen and nitrogen, monomer containing nitrile group, aliphatic hydrocarbon vinyl monomer, alicyclic hydrocarbon vinyl monomer, aromatic hydrocarbon vinyl monomer, vinyl ester, vinyl ether, vinyl ketones, vinyl monomer containing epoxy group, vinyl monomer containing halogen element, ester of unsaturated polycarboxylic acid, vinyl monomer containing hydroxyl group, vinyl monomer containing polyoxyalkylene chain, anionic group, phosphoric group, sulfonic group, or vinyl monomer containing vinyl monomer having ionic group containing sulfate ester group; and monovalent metal salt, divalent metal salt, amine salt and ammonium salt, etc. of the above monomers.

Among these, specifically, preferable examples of (E5) component include a monomer containing nitrogen such as 4-diphenylamine (meth)acrylamide, 2-diphenylamine (meth) acrylamide, dimethyl aminoethyl (meth)acrylamide, diethyl aminoethyl (meth)acrylamide, dimethyl aminopropyl (meth) acrylamide, dimethyl aminomethyl methacrylate, diethyl aminomethyl methacrylate, dimethyl aminoethyl (meth) acrylate, diethyl aminoethyl (meth)acrylate, morpholino methyl methacrylate, morpholino ethyl methacrylate, 2-vinyl-5-methyl pyridine, and N-vinyl pyrolidone.

As the (E) component of the invention, there may be a poly (meth)acrylate series compound obtained by polymerizing or copolymerizing one or more kind of monomers selected from the above (E1)~(E5), or a mixture of one or more kinds selected from the poly (meth)acrylate series compounds. More preferable examples include:

1) non-dispersant poly (meth)acrylate (copolymer of (E1) and (E2)), or the hydrogenated product thereof;
2) non-dispersant poly (meth)acrylate (copolymer of (E2) and (E3)), or the hydrogenated product thereof;
3) non-dispersant poly (meth)acrylate (copolymer of (E1), (E2), and (E3)), or the hydrogenated product thereof;
4) non-dispersant poly (meth)acrylate (copolymer of (E1), (E2), (E3), and (E4)), or the hydrogenated product thereof;
5) dispersed poly (meth)acrylate (copolymer of (E1), (E2), and (E5)), or the hydrogenated product thereof;
6) dispersed poly (meth)acrylate (copolymer of (E1), (E2), (E3), and (E5)), or the hydrogenated product thereof; and
7) dispersed poly (meth)acrylate (copolymer of (E1), (E2), (E3), (E4), and (E5)), or the hydrogenated product thereof.

As the (E) component of the invention, it is preferably non-dispersed poly (meth)acrylate series compounds of the above 1)~4), more preferably non-dispersed poly (meth)acrylate series compounds of the above 2)~4), and particularly preferably a non-dispersed poly (meth)acrylate series compound of the above 3).

Since the (E) in the lubricating oil composition of the present invention, i.e. poly (meth)acrylate series additive, in view of handleability and solubility to the lubricant base oil, is normally provided in a state being diluted to the concentration of about 10~90 mass % by diluent, the content to the total mass of the composition, as the content including the diluent, is 0.1~15 mass %, preferably 2~12 mass %, and particularly preferably 3~8 mass %. If the content of (E) component exceeds the above range, improvement of the low-temperature viscosity properties cannot be expected, but also its shear stability is inferior, thus it is not preferable.

Among the (E) component, commercially-supplied poly (meth)acrylate series additives as a conventional viscosity index improver are effective for improving viscosity-temperature property particularly from cold to high temperature. Among these, a poly (meth)acrylate series additive which contains (E1) as the structural unit is preferable. The weight-average molecular weight of the poly (meth)acrylate is, in general, 10,000~1,000,000, preferably 100,000~500,000, and more preferably 150,000~300,000.

Moreover, among the (E) component, commercially-supplied poly (meth)acrylate series additives as a conventional pour-point depressant are effective for improving low-temperature viscosity properties such as pour-point and BF viscosity and for enhancing these effects. Among these, (E1) may be included or may not be included as the structural unit; (E1) is preferably included as the structural unit. The weight-average molecular weight of the poly (meth)acrylate is, in general, 10,000~300,000, preferably 20,000~100,000, and more preferably 50,000~80,000.

As the (E) component of the invention, a first poly (meth) acrylate series additive of which weight-average molecular weight is 10,000~100,000, preferably 20,000~80,000, particularly preferably 50,000~70,000; and a second poly (meth) acrylate series additive of which weight-average molecular weight is 100,000~1,000,000, preferably 150,000~500,000, and particularly preferably 150,000~300,000, are favorably used at the same time. The content of the first poly (meth) acrylate series additive, to total mass of the composition, as the content including the diluent, is preferably 0.1~15 mass %, more preferably 0.1~2 mass %, and particularly preferably 0.2~1 mass %; while, the content of the second poly (meth) acrylate series additive, to total mass of the composition, as the content including the diluent, is preferably 0.1~15 mass %, more preferably 2~12 mass %, and particularly preferably 3~8 mass %; and the ratio of content of the poly (meth) acrylate series additive including the diluent, by representing in mass ratio, is preferably 1:0.01~1:150, more preferably 1:1~1:100, and particularly preferably 1:10~1:50. Such combination are effective for improving the low-temperature viscosity properties such as pour-point and BF viscosity, for improving viscosity-temperature property from low-temperature to high temperature, but also for enhancing the above effects.

The hydraulic oil composition of the invention is the above-mentioned hydraulic oil composition having a specific base oil for hydraulic oil containing poly (meth)acrylate series additive (E). So as to further improve the properties or to add other various properties required of the common lubricating oil particularly for both tractors and transmissions, if necessary, various additives such as viscosity index improver other than (E) component, (F) cold flow improver, extreme pressure agent, dispersant, metallic detergent, friction modifier, antioxidant, corrosion inhibitor, rust inhibitor, demulsifier, metal deactivator, seal swelling agent, defoamant, and coloring agent may be blended. These are used alone or in combination with two or more thereof.

Specific examples of viscosity index improver other than (E) include non-dispersed or dispersed ethylene-α-olefin copolymer or the hydrogenated product thereof, polyisobutylene or the hydrogenated product thereof, styrene-diene hydrogenated copolymer, styrene-maleic acid anhydride ester copolymer, and polyalkyl styrene.

When the viscosity index improver other than (E) is blended to the lubricating oil composition of the present invention, the dosage is usually 0.1~15 mass %, preferably 0.5~5 mass %, to total mass of the composition.

As (F) cold flow improver, there may be a commonly known cold flow improver having a property which reforms the crystal structure of wax mainly containing n-paraffin that is precipitated at 10° C. or less. For example, commonly known cold flow improvers used for reforming cold flow of the so-called "middle distillate fuel" like gas oil and Bunker A; specifically, (F1) (co)polymer of a monomer containing unsaturated ester;

(F2) polyalkylene glycol carboxylic acid ester;

(F3) hydrocarbyl amine, and reaction product of the amine with carboxylic acid;

(F4) phenolic resin; and mixtures thereof.

As (F1), specifically, there may be vinyl acetate polymer, (meth)acrylate (co)polymer, di-n-dodecyl and/or di-n-tetradecyl fumarate (co)polymer, copolymer of di-n-dodecyl and/or di-n-tetradecyl fumarate and vinyl acetate, ethylene-vinyl acetate copolymer, maleic acid di(2-ethylhexyl) adduct of ethylene-vinyl acetate copolymer, ethylene-vinyl acetate-di-n-dodecyl and/or di-n-tetradecyl fumarate copolymer, ethylene-(meth)acrylate copolymer, α-olefin (of carbon number 2~24)-maleic acid dibutyl copolymer.

As (F2), specifically, there may be an ester of a poly ethylene glycol with carboxylic acid of carbon number 12~24, like behenic acid ester of poly ethylene glycol.

As (F3), specifically, there may be hydrocarbyl amine consisting of polyamine such as carbon number 1~30, preferably carbon number 6~30 of aliphatic monoamine, diamine, triamine, and tetraamine, or of aromatic monoamine, diamine, triamine, and tetraamine; alkyl or alkenyl succinic amide; reaction product of the above aliphatic amine with alkyl or alkenyl spiro-bis-lactone; reaction product of the above aliphatic amine with the above phthalic acid (anhydride); and reaction product of the above aliphatic amine with ethylene diaminetetraacetic acid. The aliphatic amine is preferably secondary amine.

As (F4), the examples include a phenolic resin such as copolymer of alkyl phenol having alkyl group of carbon number 1~30 with formaldehyde.

In the invention, (F1) (co)polymer of a monomer including unsaturated ester, specifically an ethylene-vinyl acetate copolymer cold flow improver may be preferably used. In addition to (F1), more preferably, one or more kinds selected from (F2)~(F4) components may be added at the same time. The additive mass of (F) cold flow improver, to total mass of the composition, is preferably 0.005~0.5 mass %, more preferably 0.01~0.2 mass %, and particularly preferably 0.02~0.15 mass %. Commercial products sold as "cold flow improver" are sometimes diluted with solvent having adequate active ingredient for contributing to the cold flow to improve the handleability and oil solubility. When these commercial products are added to the hydraulic oil composition of the present invention, the above additive mass means the mass including the diluent.

Examples of the extreme pressure agent include: sulphur-containing extreme pressure agent such as sulfurized fats, sulfurized olefin, dihydrocarbyl polysulfides, dithiocarbamates, thiadiazoles, and benzothiazoles; phosphorus-containing extreme pressure agent such as phosphate (or phosphite), and phosphoester (or phosphite ester), derivatives thereof, amine salt thereof, and metal salt thereof; and phosphorus-sulphur extreme pressure agent such as thiophosphate (or thiophosphite), thiophosphoester (or thiophosphite ester), derivatives thereof, amine salt thereof, and metal salt (e.g. zinc dithiophosphate) thereof.

When the extreme pressure agent is blended to the lubricating oil composition of the invention, the dosage is usually 0.1~10 mass %, preferably 0.5~5 mass %, to total mass of the composition.

As the dispersant, any kind of compounds normally used as a dispersant for lubricating oil may be used, there may be an ashless dispersant like succinimide, benzylamine, polyamine, and/or derivatives (e.g. boron compound derivatives) thereof, these of which having a hydrocarbon group of carbon number 40~400.

When the dispersant is blended to the lubricating oil composition of the invention, the dosage is usually 0.1~15 mass %, preferably 0.5~10 mass %, to total mass of the composition.

As the metallic detergent, any kind of compounds normally used as a metallic detergent for lubricating oil may be used, there may be a metallic detergent like alkali earth metal sulfonate of which base number is 0~500 mg KOH/g, alkali earth metal phenate, and alkali earth metal salicylate.

When the metallic detergent is blended to the lubricating oil composition of the invention, the dosage is usually 0.1~15 mass %, preferably 0.5~10 mass %, to total mass of the composition.

As the friction modifier, any kind of compounds normally used as a friction modifier for lubricating oil, amine compound, fatty acid ester, aliphatic alcohol, fatty acid amide, fatty acid metal salt, and the like, these of which having at least one alkyl group or alkenyl group of carbon number 6~30, particularly straight-chain alkyl group or straight-chain alkenyl group of carbon number 6~30, in the molecule.

In the invention, one or more kind of compounds selected from the above friction modifiers may be added by an arbitrary mass; the mass is usually 0.01~5 mass %, preferably 0.03~3 mass %, to total mass of the composition.

As the antioxidant, any kind of antioxidants, which is generally used for lubricating oil, such as phenolic compound and aminic compound may be applicable. Specifically, alkyl phenols such as 2,6-di-tert-butyl-4-methyl phenol; bisphenols such as methylene-4,4-bisphenol (2,6-di-tert-butyl-4-methyl phenol); naphthyl amines such as phenyl-α-naphthyl amine; dialkyl diphenylamines; dialkyl zinc dithiophosphates such as di-2-ethylhexyl zinc dithiophosphates; and esters of (3,5-di-tert-butyl-4-hydroxyphenyl) fatty acid (propion acid, etc.) or (3-methyl-5-tert-butyl-4-hydroxyphenyl) fatty acid (propion acid, etc.) and monovalent or polyvalent alcohol (e.g., methanol, octanol, octadecanol, 1,6-hexadiol, neopentyl glycol, thio diethylene glycol, triethylene glycol, pentaerythritol).

One or more kind of compounds selected from these antioxidants may be contained by an arbitrary mass; the mass is usually 0.01~5 mass %, preferably 0.1~3 mass %, to total mass of the composition.

Examples of the corrosion inhibitor include benzotriazole, tolyltriazole, thiadiazole, and imidazole compounds.

Examples of the rust inhibitor include petroleum sulfonate, alkylbenzene sulfonate, dinonyl naphthalene sulfonate, alkenylsuccinic acid ester, and polyvalent alcohol ester.

Examples of the demulsifier include a polyalkylene glycol nonionic surfactant such as polyoxy ethylene alkyl ether, polyoxy ethylene alkyl phenylether, and polyoxy ethylene alkyl naphthyl ether.

Examples of the metal deactivator include imidazoline, pyrimidine derivatives, alkyl thiadiazole, mercapto benzothiazole, benzotriazole or derivatives thereof, 1,3,4-thiadiazole polysulfide, 1,3,4-thiadiazolyl-2,5-bis dialkyl dithiocarbamate, 2-(alkyl dithio)benzoimidazole, and β-(o-carboxy benzylthio) propionitrile.

As the defoamant, any kind of compounds usually used as a defoamant for lubricating oil may be used. For example, silicones such as dimethyl silicone, fluorosilicone may be used. One or more kind of compounds selected from these defoamants may be contained by an arbitrary mass.

As the seal swelling agent, any kind of compounds usually used as a seal swelling agent for lubricating oil may be used. For instance, a seal swelling agent such as ester compounds, sulphur compounds, and aromatic seal swelling agent may be used.

As the coloring agent, any kind of compounds usually used as a coloring agent may be used and it can be blended by an arbitrary mass. The dosage is usually 0.001~1.0 mass %, to total mass of the composition.

When these additives are contained in the lubricating oil composition of the present invention, each content of these additives to total mass of the composition is normally determined in the following range: contents of the corrosion inhibitor, rust inhibitor, and demulsifier are respectively 0.005~5 mass %; the content of metal deactivator is 0.005~2 mass %; the content of defoamant is 0.0005~1 mass %; and the content of seal swelling agent is 0.01~5 mass %.

Kinematic viscosity at 100° C. of the hydraulic oil composition of the invention is preferably 6~15 $mm^2/s$, more preferably 7~9.5 $mm^2/s$, particularly preferably 7.5~8.5 $mm^2/s$ so as to maintain some necessary properties like low-temperature filterability and wear-inhibiting property of the composition as a hydraulic oil.

Viscosity index of the hydraulic oil composition of the invention, as viscosity characteristics thereof from low temperature to high temperature is favorable, is preferably 160 or more, more preferably 200 or more, and particularly preferably 220~250.

Moreover, BF viscosity (Brookfield viscosity) at −40° C. of the hydraulic oil composition of the invention, so as to give practical cold flow in the range which does not raise the cost high and so as to satisfy both anti-wear property and the cold flow, is preferably 21000 mPa·s or less, preferably 5000~15000 mPa·s, more preferably 6000~13000 mPa·s, more preferably 7000~10000 mPa·s or less, and particularly preferably 8000~9000 mPa·s.

EXAMPLES

Hereinafter, the present invention will be more specifically described by way of the following examples. However, the invention is not limited by these examples.

Comparative Example 1, Examples 1~4

Based on the compositions shown in Table 1, hydraulic oil compositions (Examples 1~5) using base oil for hydraulic oil of the present invention and hydraulic oil compositions for comparison (Comparative examples 1 and 2) using base oil for hydraulic oil which does not satisfy the requirement of the present invention were prepared. By using the obtained compositions, low-temperature filterability test was carried out in accordance with the following condition. The results are shown in Table 2.

<Low-Temperature Filterability Test>

By using a test equipment, a filter, and oil filters of which diameter is 12.5 mm and pore diameter is 20~30 μm defined in the test equipment: JIS K 2288 "Diesel fuel-Determination of cold filter plugging point", a 200 ml of test sample was set to the test equipment. The temperature of the sample was kept at 25° C. for 30 minutes, then the sample was cooled down to −30° C. at the cooling rate of 5° C./h. After that, it was left for 10 hours, and suction filtration was started at the suction pressure of 100.0 kPa. The filtering time was determined as a time (second) until the suction amount of the supplied oil becomes 20 ml. The wording "suction pressure 100.0 kPa" means "1.3 kPa under absolute pressure", in other words, "−100.0 kPa to atmospheric pressure (101.3 kPa)" or "100.0 kPa of reduced or differential pressure to atmospheric pressure".

TABLE 1

| Base oil | Base oil (A1) | Base oil (A2) | Base oil (B1) | Base oil (B2) | Base oil (C) |
|---|---|---|---|---|---|
| Raw material | Vacuum gas oil [1] | Vacuum gas oil [1] | Vacuum gas oil [2] | Vacuum gas oil [1] | Vacuum gas oil [1] |
| Manufacturing/refining process | Hydrocracking [3] | Hydrocracking [3] | Solvent refining [4] | Hydrocracking [3] | Hydrocracking [3] |
| Dewaxing process | Hydroisomerization [5] | Hydroisomerization [5] | Solvent dewaxing [6] | Solvent dewaxing [6] | Solvent dewaxing [6] |
| Kinematic viscosity (100° C.) ($mm^2/s$) | 4.3 | 3.1 | 4.4 | 2.7 | 4.1 |
| Viscosity index | 123 | 105 | 100 | 109 | 120 |
| Pour-point (° C.) | −17.5 | −45.0 | −15.0 | −32.5 | −22.5 |
| Aniline point (° C.) | 116 | 108 | 97 | 104 | 112 |
| % $C_P$ | 78.9 | 74.6 | 65.1 | 75.6 | 78.0 |
| % $C_N$ | 21.1 | 25.2 | 30.5 | 23.5 | 20.7 |
| % $C_A$ | 0.0 | 0.3 | 4.4 | 0.9 | 1.3 |
| $^{13}$C-NMR Analysis | | | | | |
| Integral intensity attributing to total carbon atoms [7] | 100 | 100 | — | 100 | 100 |
| Integral intensity attributing to tertiary carbon atoms [8] | 8.0 | 7.6 | — | 7.2 | 6.9 |
| Average carbon number | 29 | 24 | — | 23 | 29 |

[1] A raw material for hydrocracking obtained by processing crude-oil topping bottom by vacuum distillation, and desulfurization thereafter.
[2] Material obtained by processing crude-oil topping bottom by vacuum distillation, then fractioned.
[3] Hydrocracking process of aromatic component, nitrogen compound, sulfur compound, etc. by using catalyst supporting metal mainly containing eighth element transition metal.
[4] Solvent refining process by use of solvent like furfural, further including hydrorefining process.
[5] Dewaxing process for partly decomposing wax component together with hydroisomerization.
[6] Solvent dewaxing process by use of solvent like MEK.
[7] Total mass of integral intensity at 0-50 ppm.
[8] Total mass of integral intensity at 27.9-28.1 ppm, 28.4-28.6 ppm, 32.6-33.2 ppm, 34.4-34.6 ppm, 37.4-37.6 ppm, 38.8-39.1 ppm, and 40.4-40.6 ppm.

TABLE 2

| | | Comparative example 1 | Comparative example 2 | Example 1 | Example 2 | Example 3 | Example 4 | Example 5 |
|---|---|---|---|---|---|---|---|---|
| Base oil (to total quantity of base oil) | | | | | | | | |
| Base oil (A1) | (mass %) | | 35 | 100 | 70 | 75 | 35 | 18 |
| Base oil (A2) | (mass %) | | | | | 25 | | 47 |
| Base oil (B1) | (mass %) | 35 | 35 | | | | | 35 |
| Base oil (B2) | (mass %) | 30 | 30 | | 30 | | 5 | |
| Base oil (C) | (mass %) | 35 | | | | | 60 | |
| Ratio of Base oil (B) to total base oil | (mass %) | 65 | 65 | 0 | 30 | 0 | 5 | 35 |

TABLE 2-continued

| | | Comparative example 1 | Comparative example 2 | Example 1 | Example 2 | Example 3 | Example 4 | Example 5 |
|---|---|---|---|---|---|---|---|---|
| Kinematic viscosity (100° C.) | $mm^2/s$ | 3.6 | 3.7 | 4.2 | 3.6 | 3.9 | 4.1 | 3.7 |
| Additives (total quantity of the composition) | | | | | | | | |
| (E) PMA-1 | (mass %) | 0.2 | 0.2 | 0.2 | 0.2 | 0.2 | 0.2 | 0.2 |
| (E) PMA-2 | (mass %) | 7 | 7 | 7 | 7 | 7 | 7 | 7 |
| Other additives | (mass %) | 9 | 9 | 9 | 9 | 9 | 9 | 9 |
| Kinematic viscosity (100° C.) of composition | $(mm^2/s)$ | 7.9 | 8.2 | 9.5 | 7.9 | 7.9 | 8.2 | 8.0 |
| Viscosity index of composition | | 219 | 224 | 213 | 233 | 225 | 222 | 223 |
| BF viscosity (−40° C.) | (mPa · s) | 13000 | 12700 | 20200 | 8420 | 8170 | 12300 | 9360 |
| Filterability (−30° C.) | (sec) | 3240 | >1800 | 265 | 410 | 114 | 413 | 110 |

PMA1: Alkyl methacrylate copolymer (alkyl group: mixture of C1, C12~15, C16, and C18, Mw: 67000)
PMA2: Alkyl methacrylate copolymer (alkyl group: mixture of C1, C12~15, C16, and C18, Mw: 170000)
Other additives: including metallic detergent, ashless dispersant, antioxidant, extreme pressure agent, etc.

As clearly seen from Table 1, individual compositions (Examples 1~5) using the base oil for hydraulic oil of the present invention, which respectively having: a base oil consisting of (A1); a base oil consisting of (A1) and (B2); a base oil consisting of (A1) and (A2); a base oil consisting of (A1), (B2), and (C); and a base oil (A1), (A2), and (B1), wherein the (B) is prepared at the ratio of 0 mass % or 50 mass % or less, exhibit excellent low-temperature filterability. On the other hand, compositions (Comparative examples 1 and 2), using a base oil for hydraulic oil which does not contain (A) of the present invention or a base oil for hydraulic oil which does contain the base oil of (A) but has more ratio of (B), exhibits inferior low-temperature filterability. It is understood that the low-temperature filterability seems almost irrelevant to one of the indexes of low-temperature performance, BF viscosity at −40° C.

INDUSTRIAL APPLICABILITY

The hydraulic oil composition of the present invention is suitably used for hydraulic systems having filters of which micropore diameter is 50 μm or less and preferably used in cold regions without causing filter blockage. Thus, the hydraulic oil composition of the invention is suitable for hydraulic systems, and also suitably used for a common lubricating oil for tractors having the hydraulic systems, transmissions (automatic transmission, manual transmission, continuously-variable transmission, etc.), and so on having the hydraulic systems, especially a common lubricating oil for tractors having both the hydraulic systems and transmissions.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that base oil for hydraulic oil and composition using the same with such an alternation are included in the technical scope of the invention.

What is claimed is:

1. A method for lubricating a hydraulic system operating at low temperature having an oil filter comprising the step of:

supplying a hydraulic oil composition to the hydraulic system operating at low temperature;

wherein said hydraulic oil composition is filtered with the oil filter whose pore diameter is 50 μm or less, and the hydraulic oil composition comprises:

a mineral base oil (A) having kinematic viscosity at 100° C. of 1.5 to 5 $mm^2/s$, pour point of −50° C. to −10° C., viscosity index of 100 or more, % $C_P$ of 70 or more, % $C_A$ of 2 or less, and aniline point of 106° C. or higher, containing tertiary carbon atoms at a ratio of 7.4 to 10% to the total carbon atoms of the mineral base oil (A), and being treated by catalytic dewaxing process;

a mineral base oil (B) having kinematic viscosity at 100° C. of 1.5 to 6 $mm^2/s$, and aniline point of lower than 106° C.; and a poly (meth)acrylate additive, and the content of the base oil (B) to the total amount of the base oil (A) and the base oil (B) is 5 to 40 mass %.

2. The method according to claim 1, wherein the mineral base oil (A) is a mineral base oil (A1) having kinematic viscosity at 100° C. of 3.5 to 4.5 $mm^2/s$, pour point of −35° C. to −10° C., viscosity index of 115 or more, % $C_P$ of 70 or more, % $C_A$ of 2 or less, and aniline point of 110° C. to 125° C. containing tertiary carbon atoms at a ratio of 7.5 to 10% to the total carbon atoms of the mineral base oil (A1), and being treated by catalytic dewaxing process.

3. The method according to claim 1, wherein the mineral base oil (A) is a mixture of:

a mineral base oil (A1) having kinematic viscosity at 100° C. of 3.5 to 4.5 $mm^2/s$, pour point of −35° C. to −10° C., viscosity index of 115 or more, % $C_P$ of 70 or more, % $C_A$ of 2 or less, aniline point of 110° C. to 125° C. containing tertiary carbon atoms at a ratio of 7.5 to 10% to the total carbon atoms of the mineral base oil (A1), and being treated by catalytic dewaxing process; and a mineral base oil (A2) having kinematic viscosity at 100° C. of 1.5 to 3.5 $mm^2/s$, pour point of −50° C. to −15° C., viscosity index of 100 or more, % $C_P$, of 70 or more, % $C_A$ of 2 or less, aniline point of 106° C. to 115° C., containing tertiary carbon atoms at a ratio of 7.4 to 10% to the total carbon atoms of the mineral base oil (A2), and being treated by catalytic dewaxing process, and wherein the content of the base oil (A1) in the base oil (A) is 10 mass % or more and less than 100 mass %.

4. The method according to claim 3, wherein the mineral base oil (B) is a mineral base oil (B1) having kinematic viscosity at 100° C. of 3.5 to 4.5 $mm^2/s$, pour point of −35° C. to −10° C., viscosity index of 80 to 110, % $C_P$ of 60 to 70, % $C_A$ of 2 to 10, and aniline point of 90° C. to 104° C.

5. The method according to claim 2, wherein the mineral base oil (B) is a mineral base oil (B2) having kinematic viscosity at 100° C. of 2 to 3.5 $mm^2/s$, pour point of −35° C. to −25° C., viscosity index of 80 to 115, % $C_P$ of 70 to 85, % $C_A$ of 2 or less, and aniline point of 100° C. to 105° C.

6. The method according to claim 5, wherein the hydraulic oil composition further comprises a mineral base oil (C), the base oil (C) having kinematic viscosity at 100° C. of 1.5 to 6 $mm^2/s$, and aniline point of 106° C. or higher, containing tertiary carbon atoms at a ratio of less than 7.4% to the total carbon, atoms of the base oil (C), and being treated by catalytic dewaxing process;

the content of the base oil (B) to the total amount of the base oil (A), the base oil (B), and the base oil (C) is 5 to 40 mass %; and the content of the base oil (C) to the total amount of the base oil (A), the base oil (B), and the base oil (C) is 20 mass % or more and 80 mass % or less.

7. The method according to claim 6, wherein the mineral base oil (C) is a mineral base oil having kinematic viscosity at 100° C. of 3.5 to 5 $mm^2/s$, pour point of −10° C. or lower, viscosity index of 100 to 160, % $C_P$ of 70 to 100, % $C_A$ of 2 or less, and aniline point of 108° C. to 125° C.

* * * * *